United States Patent [19]

Kleine

[11] Patent Number: 4,995,329

[45] Date of Patent: Feb. 26, 1991

[54] TIEDOWN DEVICE AND SYSTEM

[76] Inventor: Larry B. Kleine, 1937 Leicester Way, Fort Collins, Colo. 80526

[21] Appl. No.: 397,243

[22] Filed: Aug. 23, 1989

[51] Int. Cl.[5] ..... B63B 17/00

[52] U.S. Cl. ..... 114/361; 24/298

[58] Field of Search ..... 114/343, 361, 364; 24/298, 230.5 R

[56] References Cited

U.S. PATENT DOCUMENTS

| | | | |
|---|---|---|---|
| 1,249,324 | 12/1917 | Carlson | 24/230.5 R |
| 1,373,349 | 3/1921 | Peardon . | |
| 3,328,064 | 6/1967 | Simon | 24/230.5 R |
| 3,587,123 | 6/1971 | O'Boyle | 114/364 |
| 4,292,913 | 10/1981 | Siebert et al. | 114/361 |
| 4,559,677 | 12/1985 | Tracy | 24/300 |
| 4,597,351 | 7/1986 | Brainard | 441/23 |

*Primary Examiner*—Joseph F. Peters, Jr.
*Assistant Examiner*—Jesûs D. Sotelo
*Attorney, Agent, or Firm*—Fields, Lewis, Pittenger & Rost

[57] ABSTRACT

A tiedown device and system, particularly suited for releasably securing a boat cover to a boat frame, is disclosed. The device has a hook-like end fastening member to whch an end of a flexible, extensible cord of a selected length is secured. The end fastening member has an inturned end portion that forms a restricted opening or passage into the inside of the end fastening member through which the cord extends and is returned to form a first fastening loop. The other free end of the cord is secured so as to apply a selected tension to the cover as by using a knot. A set of tiedown devices in the tiedown system applies uniform tension to a boat cover or the like.

12 Claims, 2 Drawing Sheets

TIEDOWN DEVICE AND SYSTEM

TECHNICAL FIELD

This invention relates to a novel and improved tiedown device and more particularly a device and system for tiedown purposes such as tying down a boat cover to a boat transport frame.

BACKGROUND ART

A variety of relatively large covers have been heretofore provided such as, for example, to cover boats, to keep moisture and weather from the inside of the boat when not in use. In the past, rather makeshift cords or ropes and items such as bungee cords have been utilized for this purpose, but they have not been entirely satisfactory and, in particular, the hook portions on bungee cords have not been sufficiently strong to avoid coming loose and the open hook is not entirely reliable as there is a tendency for the cords to slip from the hooks. Further, there is no known tiedown system that assures a generally uniform holddown tension along the entire periphery of a relatively large cover, such as that used to cover boats.

Peardon U.S. Pat. No. 1,373,349 discloses an outwardly flared hook having an eyelet at each end of a rope with one hook permanently attached to the rope and the other hook adjusts longitudinally of the rope. Simon U.S. Pat. No. 3,328,064 discloses a tiedown device using a conventional open U-shaped hook with an eyelet along one shank and having a flexible cord looped through the eyelet and secured to the rope. A hook is also provided at the opposite end of the cord. Tracy U.S. Pat. No. 4,559,677 discloses a stretchable tiedown device having an open hook of a special hollow construction and a special fastening arrangement between the hook and the flexible cord.

DISCLOSURE OF THE INVENTION

A tiedown device disclosed includes a rigid hook-like end fastening member with a bifurcated main body and an inturned end portion defining a restricted opening to the inside of the fastening member. A flexible cord of a selected size and length is secured preferably to an eyelet at one end of the end fastening member. A resilient coating covers the secured cord and end fastening member as well as the free end of the cord. A tiedown system utilizes a plurality of the tiedown devices which are selectively attached in such a way as to apply substantially uniform tension to a cover for a boat or the like.

BRIEF DESCRIPTION OF THE DRAWINGS

Details of this invention are described in connection with the accompanying drawings in which like parts bear similar reference numerals and in which.

DETAILED DESCRIPTION

Figure 1:
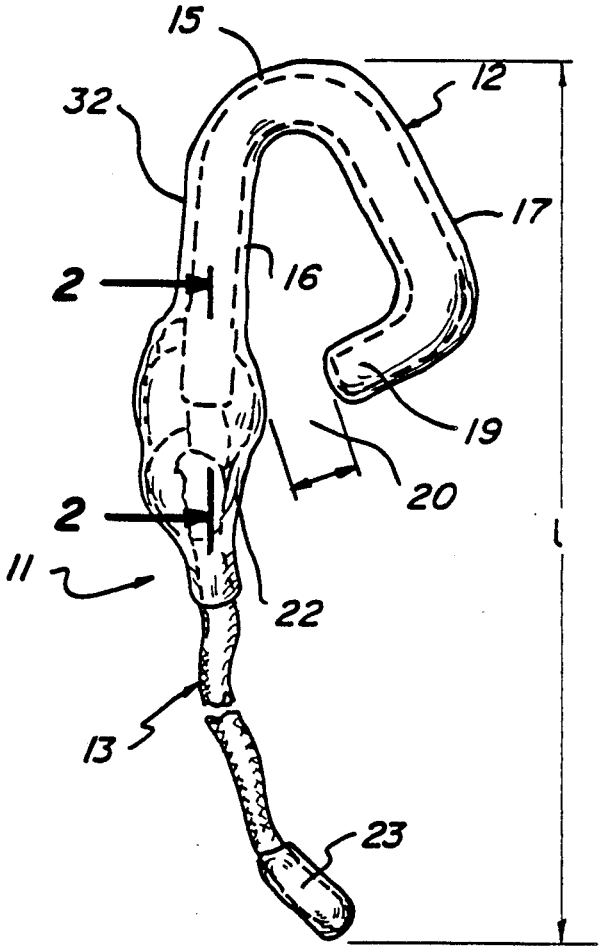
FIG. 1 is a side elevation view of a tiedown device embodying features of the present invention.

Referring now to FIGS. 1–4 a tiedown device 11 embodying features of the present invention in general includes a hook-like end fastening member 12 to which is secured one end of a flexible cord 13. The end fastening member 12 shown has a bifurcated main body of uniform cross section which includes a curved bight portion 15 from which extend two opposed diverging arm portions 16 and 17. An inturned end portion 19 extends in from arm portion 17. An end portion of the cord 13 is secured to the end member 12. A resilient coating 22 is shown covering end fastening member 12. A coating 23 is shown covering the other free end portion of the cord 13. The coating preferably is a composition of rubber or synthetic rubber to provide a resilient external surface and to avoid having the metal body scratch and further serves to hold the knot in place. A restricted opening 20 of a preselected dimension is provided between the end of end portion 19 and the connected end portion of the cord 13. The restricted opening 20 is less than the diameter of the cord in an unstretched condition and will slide through said opening when stretched. The length of the device designated "l" is shown in FIG. 1 and is typically four feet.

In the construction shown the end fastening member 12 is provided by an inner, rigid, one-piece, metal body 26 preferably of a cold-rolled steel that is zinc coated. This body 26 is shown in an unattached and uncoated condition in FIG. 3. This body 26 is made with a flattened eyelet 27 through which the secured end portion of the cord 13 is passed and the cord is secured thereto by means of a knot 28. The cord 13 is flexible and capable of being stretched along its length. Preferably, the cord is made of a synthetic rubber core and has an external braided fabric covering of a material such as nylon.

A tiedown system utilizing a set of the above described devices is shown in FIGS. 5–9. There is shown a typical boat 41 on a wheeled boat transport frame 42 and the cover 43 shown has thirteen (13) strap loops 44 at selected spaced positions throughout the periphery of the cover. The arrangement shown has a strap loop at the front, two strap loops at the rear and five strap loops on each side.

Figure 9:
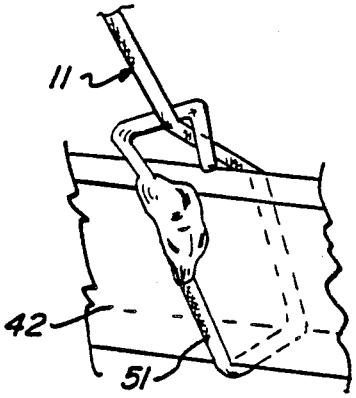
FIG. 9 is a perspective view of the other end of the tiedown device from that shown in FIG. 8 for tying down the cover.
Figure 3:
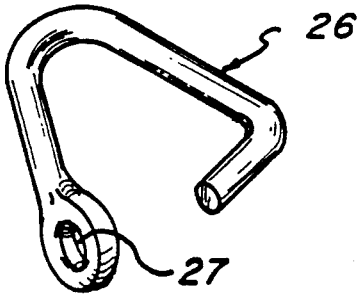
FIG. 3 is a perspective view of the end fastening body without the cord attached and prior to being coated.
Figure 2:
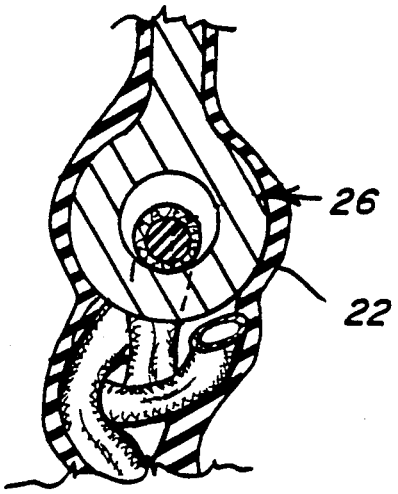
FIG. 2 is a sectional view taken along line 2—2 of FIG. 1.
Figure 4:
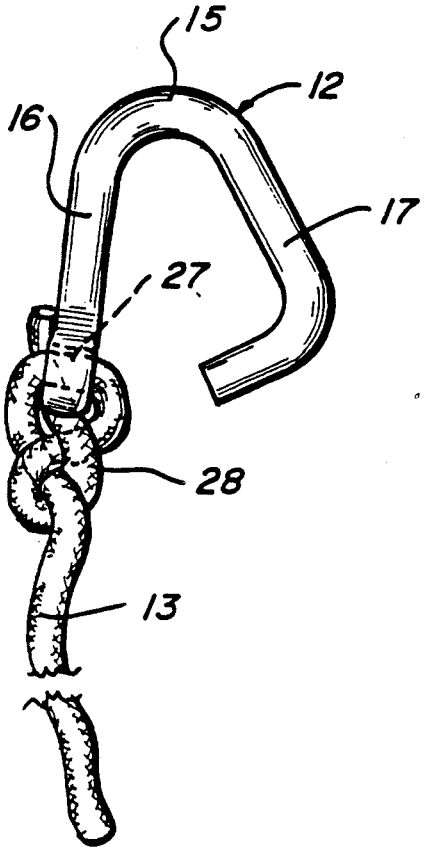
FIG. 4 is a perspective view of the end fastening body tied to the flexible cord but without the coating.

To apply each tiedown device the free end of the cord 13 is looped around the frame and back through the end fastening member 12 to form an end loop 51 as best seen in FIG. 9. The opposite end of the cord is passed through the strap loop 44 and drawn down to a selected tension and then secured as by tying a knot 47 and securing the free end of the cord with tape 48 as shown to form a second end fastening loop 55. This is repeated around the boat with substantially the same tension applied to each loop. It is understood that other quick fastening techniques may be used.

Figure 10:
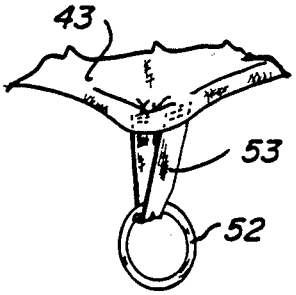

An alternative to the strap loop 44 shown in FIG. 10 found in many boat covers is a rigid metal ring 52 through a shorter strap loop 53 secured to the cover. In this case, the cord 13 would pass through the ring 52.

Figure 5:
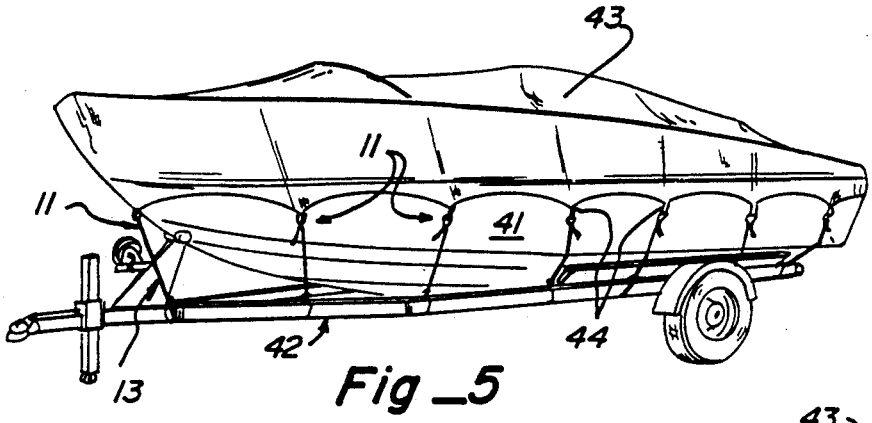
FIG. 5 is a top perspective view of a tiedown system for a boat cover embodying features of the present invention.
Figure 6:
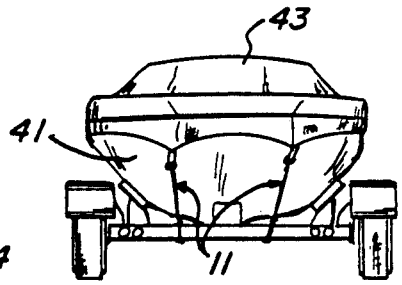
FIG. 6 is a rear elevation view of FIG. 1.
Figure 8:
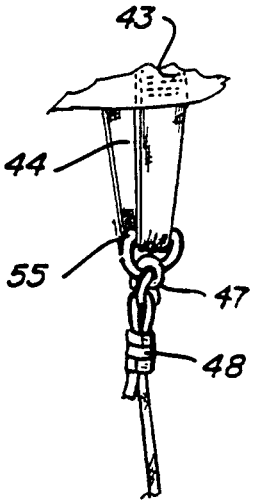
FIG. 8 is an enlarged view of one end of the tiedown device fastened to a strap loop on the boat cover and to the boat transport frame.
Figure 7:
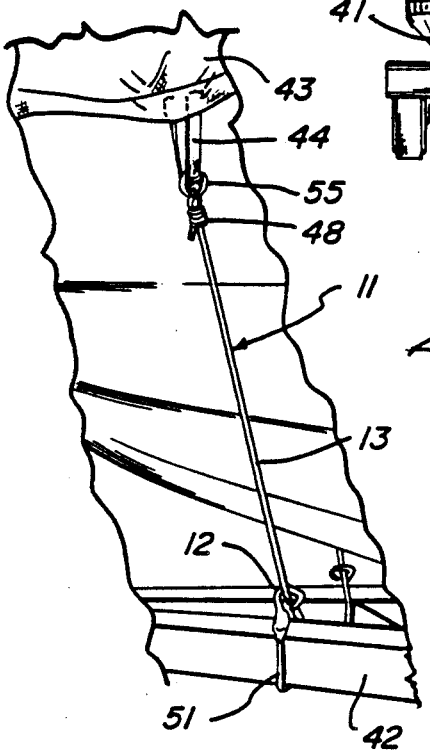
FIG. 7 is an enlarged view of one of the tiedown devices of the tiedown system shown in FIG. 1.

A typical set of the tiedown devices to provide a tiedown system for a boat cover as above described would include thirteen identical devices. These may be tied as for example six on each side and one at the front or five on each side, one at the front and two across the rear as shown in FIG. 6. The tiedown devices may be made in a range of sizes such as ¼", 5/16", ⅜" and ½" for the diameter of the cord and the body forming the end fastening member. Another typical set would be four identical devices.

Although the present invention has been described with a certain degree of particularity, it is understood that the present disclosure has been made by way of example and that changes in details of structure may be made without departing from the spirit thereof.

I claim:

1. A tiedown device comprising:

a rigid, hook-like end fastening member having a generally bifurcated main body with a bight portion from which extends first and second diverging arm portions and an inturned transverse end portion extending in from said first arm portion and arranged generally at right angles thereto to define a transverse cord retaining surface at one end of said first arm portion opposite said bight portion, and a flexible cord of a selected length and capable of being stretched along its length, said cord having a first end portion secured to said second arm portion and having an opposite free end portion, said second arm portion of said main body terminating in an eyelet through which the secured end of said cord is passed, said end fastening member having a rigid, metal inner body and a resilient external surface, said restricted opening being less than the diameter of the cord in an unstretched condition and the cord sliding through said restricted opening when stretched.

2. A tiedown device as set forth in claim 1 wherein said first end portion of said cord is tied in a knot to secure said cord to said eyelet.

3. A tiedown device as set forth in claim 1 wherein said resilient external surface is provided by a coating that covers said rigid, metal inner body and the secured one end portion of said cord and a coating covers a free end portion of said cord opposite said first end portion.

4. A tiedown device as set forth in claim 3 wherein said coating is made of a rubber composition.

5. A tiedown device as set forth in claim 3 wherein said inner body is cold-rolled steel.

6. A tiedown device as set forth in claim 1 wherein said flexible cord has a rubber core and has an external braided fabric covering.

7. A tiedown system for attaching a cover having a plurality of fastening portions at spaced intervals about the periphery of the cover to a frame, said tiedown system comprising a plurality of tiedown devices connected between said cover and said frame, each said tiedown device being connected between one of said fastening portions and said frame, each said tiedown device including:

a rigid, hook-like end fastening member having a generally bifurcated main body with a bight portion from which extends two diverging arm portions and an inturned end portion extending in from one of the arm portions and arranged generally transverse thereto to define a restricted opening, and a flexible cord of a selected length and capable of being stretched along its length, said cord having one end portion secured to the other of said arm portions and back through the inside of said end fastening member to form a fastening loop around said frame, the opposite free end portion of said cord being attached to said fastening portion of said cover with the length of each of said flexible cords being selected to apply a substantially uniform hold-down pressure about the periphery of said cover.

8. A tiedown system as set forth in claim 7 wherein said free end portion extends through a strap loop attached to the cover and is drawn to a selected length and hold-down tension and fastened in place.

9. A tiedown system as set forth in claim 8 wherein said free end portion is fastened by a knot.

10. A tiedown system as set forth in claim 7 wherein said free end portion extends through a metal ring secured to the cover by a strap loop and is drawn to a selected length and hold-down tension and fastened in place.

11. A tiedown system as set forth in claim 10 wherein there is a set of thirteen of said tiedown devices tying down said boat cover.

12. A tiedown system as set forth in claim 2 wherein said cover is a boat cover and said frame is the transport frame for a boat.

* * * * *